US010393151B2

(12) United States Patent
Ueda

(10) Patent No.: US 10,393,151 B2
(45) Date of Patent: Aug. 27, 2019

(54) HYDRAULIC DRIVE SYSTEM FOR WORKING MACHINE

(71) Applicant: KOBELCO CONSTRUCTION MACHINERY CO., LTD., Hiroshima-shi (JP)

(72) Inventor: Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 284 days.

(21) Appl. No.: 15/413,819

(22) Filed: Jan. 24, 2017

(65) Prior Publication Data

US 2017/0227028 A1 Aug. 10, 2017

(30) Foreign Application Priority Data

Feb. 5, 2016 (JP) ..... 2016-020671

(51) Int. Cl.
*E02F 9/22* (2006.01)
*F15B 11/17* (2006.01)
*F15B 11/16* (2006.01)

(52) U.S. Cl.
CPC ..... *F15B 11/165* (2013.01); *F15B 11/17* (2013.01); *E02F 9/2242* (2013.01); *E02F 9/2282* (2013.01);
(Continued)

(58) Field of Classification Search
CPC ..... F15B 11/165; F15B 2211/45
See application file for complete search history.

(56) References Cited

U.S. PATENT DOCUMENTS 7,614,225 B2 * 11/2009 Kim ..... B62D 11/005 60/421
9,051,712 B2 * 6/2015 Kodaka ..... E02F 3/962
(Continued)

FOREIGN PATENT DOCUMENTS

EP 1 925 825 A2 5/2008
JP 6-50309 A 2/1994
(Continued)

OTHER PUBLICATIONS

Extended European Search Report dated May 19, 2017 in Patent Application No. 17153464.7.

*Primary Examiner* — Michael Leslie
*Assistant Examiner* — Michael Quandt
(74) *Attorney, Agent, or Firm* — Oblon, McClelland, Maier & Neustadt, L.L.P.

(57) ABSTRACT

Provided is a hydraulic drive system including: first and second pumps; a first main supply fluid line and an optional supply fluid line leading to the first pump; a second main supply fluid line leading to the second pump; a main manipulating device for the main actuator; an optional manipulating device for the optional actuator; a bleed-off flow rate regulating section to change the bleed-off flow rate for the second pump; and a bleed-off control section to operate the bleed-off flow rate regulating section to change the discharge flow rate of the second pump in accordance with a control operation applied to the main manipulating device and to make a bleed-off flow rate in a specific combined manipulation state with simultaneous performance of a specific main control operation and an optional control operation be smaller than that in a single main manipulation state.

13 Claims, 9 Drawing Sheets

(52) U.S. Cl.
CPC ..... *E02F 9/2292* (2013.01); *E02F 9/2296* (2013.01); *F15B 2211/20546* (2013.01); *F15B 2211/20576* (2013.01); *F15B 2211/3116* (2013.01); *F15B 2211/45* (2013.01); *F15B 2211/50536* (2013.01); *F15B 2211/7051* (2013.01); *F15B 2211/7142* (2013.01)

(56) References Cited

U.S. PATENT DOCUMENTS

| | | | | |
|---|---|---|---|---|
| 2008/0296522 | A1 | 12/2008 | Yamashita et al. | |
| 2012/0198831 | A1* | 8/2012 | Kodaka ..... | E02F 3/962 60/422 |
| 2015/0040552 | A1 | 2/2015 | Hashimoto | |
| 2015/0059331 | A1 | 3/2015 | Hashimoto | |

FOREIGN PATENT DOCUMENTS

| | | | |
|---|---|---|---|
| JP | 9-217385 | | 8/1997 |
| JP | 2007-100779 | A | 4/2007 |
| JP | 2014-9794 | A | 1/2014 |

* cited by examiner

HYDRAULIC DRIVE SYSTEM FOR WORKING MACHINE

TECHNICAL FIELD

The present invention relates to a hydraulic drive system to be provided to a working machine including a working attachment having a distal end to which an optional device is mountable, for hydraulically driving the working attachment and the optional device by hydraulic pressure.

BACKGROUND ART

In the case of a working machine including a working attachment having a movable distal end, an optional device may be mounted to the distal end. For example, a common hydraulic excavator is equipped with a working attachment including a raisable and lowerable boom and an arm pivotally connected to a distal end of the boom, the arm having a distal end to which a bucket is mountable. In place of the bucket, an optional device such as nipping type of crusher or breaker may be mounted to the distal end of the arm.

As a conventional system for hydraulically driving such a working attachment and an optional device, there is known one shown in FIG. 9 (Japanese Unexamined Patent Publication No. Hei 9-217385). The system includes: a first pump 91; a second pump 92; an arm cylinder 93 for actuating an arm of the working attachment; an optional cylinder (auxiliary actuator) 94 for actuating the optional device; an arm direction selector valve V1 disposed between the first pump 91 and the atm cylinder 93; and an auxiliary direction selector valve V2 disposed between the first pump 91 and the optional cylinder 94.

In this system, both the direction selector valves V1 and V2 are disposed in series along a common center bypass line joined to the first pump 91, while being connected to the first pump 91 in parallel with each other through an arm supply fluid line 95 and an auxiliary supply fluid line 96, respectively. Therefore, hydraulic fluid discharged from the first pump 91 can be supplied to the arm cylinder 93 through the arm supply fluid line 95 and the arm direction selector valve V1, and supplied to the optional cylinder 94 through the auxiliary supply fluid line 96 and the auxiliary direction selector valve V2.

However, the system involves the following problem: the load required by the optional cylinder 94 for actuating the optional device is significantly smaller than the load required by the arm cylinder 93 for actuating the arm, which generates a possibility that most of hydraulic fluid discharged from the hydraulic pump 91 is flowed into the optional cylinder 94 to thereby reduce the actuation speed of the arm cylinder 93 significantly, if no measures are taken.

To solve the problem, the system includes a variable aperture valve 97 and a control valve 98 for regulating the flow rate distribution during simultaneous driving of both of the cylinders 93 and 94. The variable throttle valve 97, which is disposed in the auxiliary supply fluid line 96, includes a pilot port and has a function of reducing the flow path area with increase in the pilot pressure supplied to the pilot port. The control valve 98, which is interposed between a pilot line of the arm direction selector valve V1 and the pilot port of the variable throttle valve 97, has a function of providing a pilot pressure to the pilot port of the variable throttle valve 97 and increasing the pilot pressure with increase in the pilot pressure input to the arm direction selector valve V1, i.e., increase in the amount of a control operation applied to an arm control lever for operating the arm.

According to this system, the flow path area of the variable throttle valve 97 is decreased with increase in the amount of the control operation applied to the arm control lever to thereby increase the flow rate of hydraulic fluid supplied to the arm cylinder 93. This makes it possible to increase a flow rate of hydraulic fluid supplied to the arm cylinder 93 with increase in the control operation amount of the arm control lever for the arm cylinder 93, even when the load required by the arm cylinder 93 is significantly greater than that required by the optional cylinder 93.

However, in the system shown in FIG. 9, although the flow rate of hydraulic fluid supplied to the arm cylinder 93 increases by the amount of reduction in the flow rate of hydraulic fluid supplied to the optional cylinder 94 at the time of combined manipulations, the flow rate of hydraulic fluid supplied to the atm cylinder 93 greatly depends on the flow rate of hydraulic fluid flowing in the optional cylinder 94. Furthermore, since the flow rate of hydraulic fluid flowing in an optional device significantly varies depending on the type or size of the optional device mounted on the working attachment, it is very difficult to stabilize the flow rate of hydraulic fluid supplied to the arm cylinder 93 so as to drive the arm cylinder 93 at a speed required by an operator regardless of the type of the optional device and the like. For example, in the case where a nipping type of crusher as the optional device is mounted to the distal end of the arm constituting the working attachment and an opening/closing control operation for opening (nipping) action or closing (releasing) action of the nipping type of crusher and a slight arm-advance control operation for raising the arm (i.e., actuating the arm in an arm pushing direction) at a restricted speed are simultaneously performed, most of hydraulic fluid discharged from the hydraulic pump is used to actuate the nipping type of crusher requiring a small load, thus preventing a driving force enough to actuate the arm in the arm pushing direction from being secured, which may disable the arm from moving.

SUMMARY OF INVENTION

The object of the present invention is to provide a hydraulic drive system to be provided to a working machine including a working attachment and an optional device mounted on the working attachment, for hydraulically driving the working attachment and the optional device, the hydraulic drive system being capable of providing a stable flow rate of hydraulic fluid supplied to the main actuator, regardless of the flow rate of hydraulic fluid flowing in the optional actuator during simultaneous performance of a control operation for causing the main actuator to make a specific action and a control operation for operating the optional actuator.

Provided is a hydraulic drive system to be provided to a working machine including a working attachment having a distal end to which an optional device is mountable, for driving the working attachment and the optional device by hydraulic pressure, the hydraulic drive system comprising: a main actuator connected to the working attachment so as to actuate the working attachment by receiving a supply of hydraulic fluid; an optional actuator connected to the optional device so as to actuate the optional device by receiving a supply of hydraulic fluid; a first pump that discharges hydraulic fluid; a second pump that discharges discharging hydraulic fluid independently of the first pump;

a first main supply fluid line for leading hydraulic fluid discharged from the first pump to the main actuator; an optional supply fluid line for leading hydraulic fluid discharged from the first pump to the optional actuator in parallel with the first main supply fluid line; a second main supply fluid line for leading hydraulic fluid discharged from the second pump to the main actuator through a different path from the first main supply fluid line; a main manipulating device to which a main control operation for manipulating the main actuator is applied; an optional manipulating device to which an optional control operation for manipulating the optional actuator is applied; a first main control valve operable to control the supply of hydraulic fluid to the main actuator through the first main supply fluid line in accordance with the main control operation applied to the main manipulating device; an optional control valve operable to control the supply of hydraulic fluid to the optional actuator through the optional supply fluid line in accordance with the optional control operation applied to the optional manipulating device; a second main control valve operable to control the supply of hydraulic fluid to the main actuator through the second main supply fluid line in accordance with the main control operation applied to the main manipulating device; a bleed-off fluid line for returning hydraulic fluid discharged from the second pump to a tank so as to bypass the main actuator; a bleed-off flow rate regulating section configured to regulate a bleed-off flow rate which is the flow rate of hydraulic fluid flowing in the bleed-off fluid line; and a bleed-off control section configured to control the bleed-off flow rate regulating section to make the bleed-off flow rate corresponding to the control operation applied to the main manipulating device in a specific combined manipulation state where a specific main control operation for bringing the main actuator into specific action is applied to the main manipulating device and an optional control operation for operating the optional actuator is applied to the main manipulating device, simultaneously, be smaller than the bleed-off flow rate corresponding to the control operation in a single main manipulation state where no optional control operation is applied to the optional manipulating device while a main control operation is applied to the main manipulating device.

These and other objects, features and advantages of the present invention will become more apparent upon reading the following detailed description along with the accompanying drawings.

DESCRIPTION OF EMBODIMENTS

Preferred embodiments of the present invention will be described with reference to the accompanying drawings.

Figure 2:
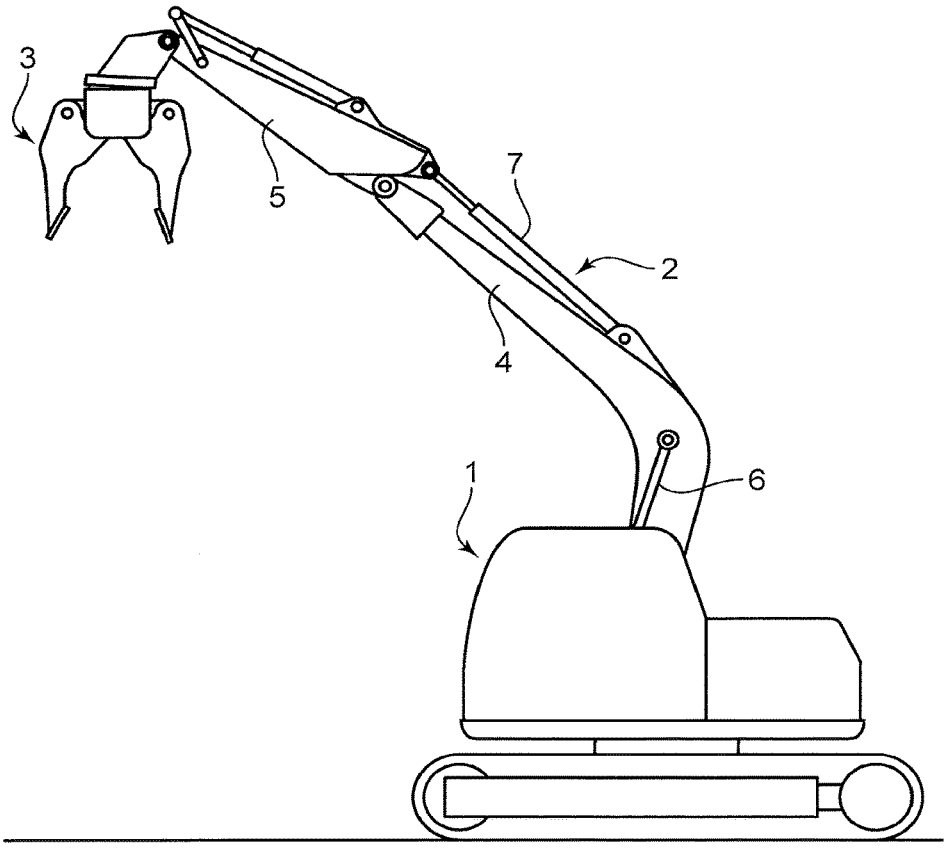
FIG. 2 is a front view of an exemplary working machine equipped with the hydraulic drive system.

FIG. 2 shows an exemplary working machine equipped with a hydraulic drive system according to each of the embodiments. The working machine is configured by utilization of an existing hydraulic excavator as its main body, including: a base machine 1; a working attachment 2 mounted on the base machine 1; and an optional device 3 detachably mounted to a distal end of the working attachment 2. The working attachment 2 includes a boom 4 mounted on the base machine 1 in a raisable and lowerable manner, and an arm 5 pivotally connected to a distal end of the boom 4, the arm 5 having a distal end on which the optional device 3 is attached. The optional device 3 according to the embodiments is a nipping type of crusher having a pair of crushing blades capable of opening (nipping) action and closing (releasing) action and operable to crush an object by the open/close actions of the pair of crushing blades.

The working machine further includes a boom cylinder 6 and an arm cylinder 7. The boom cylinder 6, which is a hydraulic cylinder disposed between the base machine 1 and the boom 4, receives a supply of hydraulic pressure to expand and contract, thereby bringing the boom 4 into respective rotational movements in a raising direction and in a lowering direction. The arm cylinder 7, which is a hydraulic cylinder disposed between the boom 4 and the arm 5, receives a supply of hydraulic pressure to expand and contract, being connected to the arm 5 so as to bring the arm 5 into respective rotational movements in a crowding direction (a direction of approaching the boom 4) and an pushing direction (a direction of going away from the boom 4) by the expansion and contraction thereof, respectively.

Figure 1:
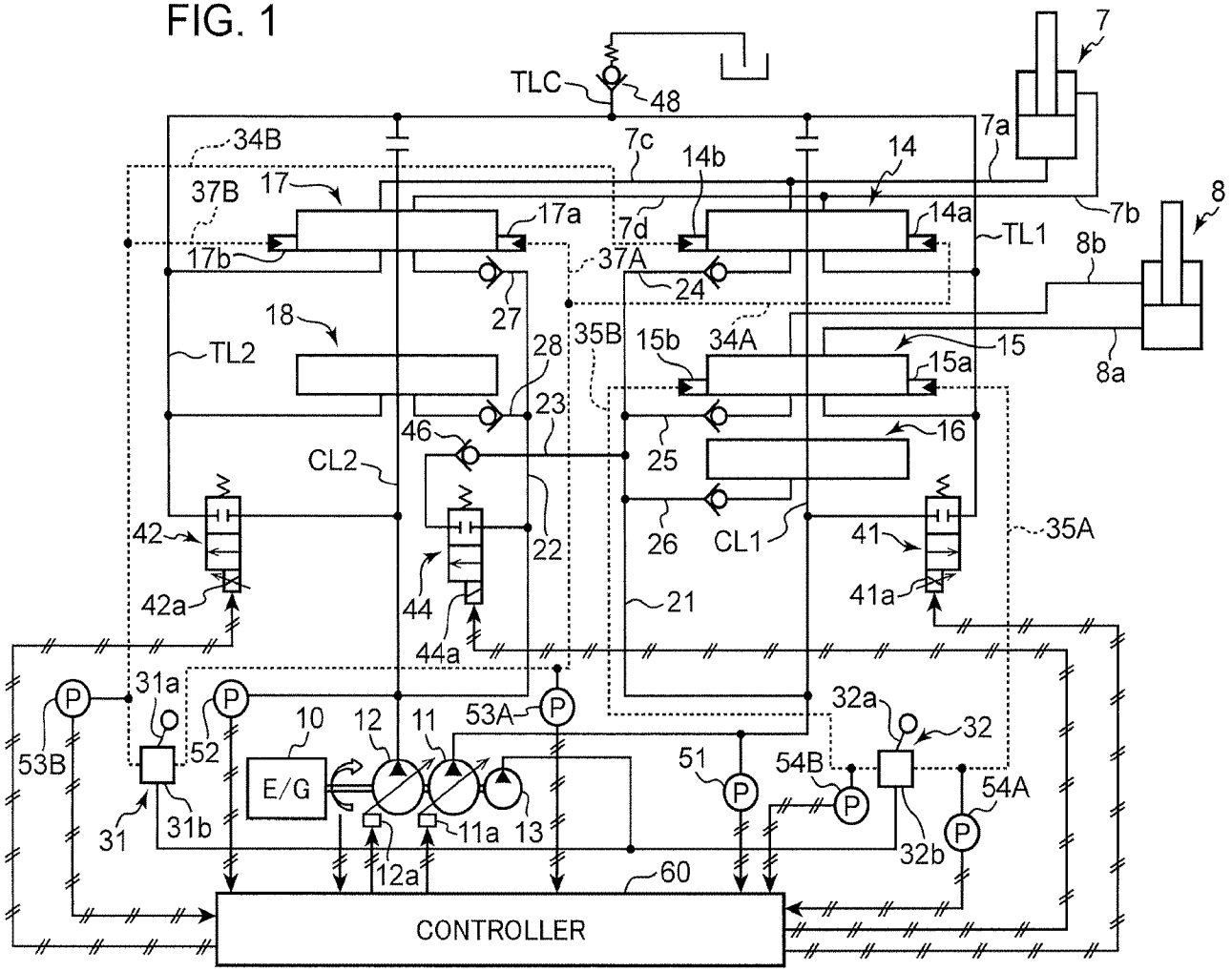
FIG. 1 is a circuit diagram of a hydraulic drive system according to a first embodiment of the present invention.

FIG. 1 shows a hydraulic drive system according to a first embodiment of the present invention for hydraulically driving the working attachment 2 and the optional device 3. The hydraulic drive system includes a plurality of hydraulic actuators, namely, includes, in addition to the boom cylinder 6 and the arm cylinder 7, an unillustrated travelling motor and an optional cylinder 8 for driving the optional device 3. The optional cylinder 8 according to this embodiment is a hydraulic cylinder connected to the crushing blades of the nipping type of crusher corresponding to the optional device 3 so as to bring the crushing blades into opening and closing actions, i.e., nipping and releasing actions, the optional device 3 is connected to the circuit shown in FIG. 1 when it is mounted to the distal end of the arm 5.

The hydraulic drive system shown in FIG. 1 includes a first pump 11, a second pump 12, a pilot pump 13, direction selector valves 14, 15, 16 connected to the first pump 11, direction selector valves 17, 18 connected to the second pump 12, an arm manipulating device 31, an optional manipulating device 32, a first bleed-off control valve 41, a second bleed-off control valve 42, a merging selector valve 44, and a merging check valve 46.

Each of the pumps 11 to 13 is a hydraulic pump driven by an engine 10 to discharge hydraulic fluid in a tank independently of each other, each of at least the first and second pumps 11 and 12 among which is formed of a variable displacement type hydraulic pump. Specifically, the first and second pumps 11 and 12 are provided with respective regulators 11*a* and 12*a*, which receive respective displacement volume instruction signals described later to thereby adjust respective displacement volumes of the first and second pumps 11 and 12 to respective displacement volumes corresponding to the input volume instruction signals.

The first pump 11 has a discharge port connected to a first center bypass line CL1 and a first tank line TL1 which lines are arranged in parallel with each other, and the second pump 12 has a discharge port connected to a second center bypass line CL2 and a second tank line TL2 which lines are arranged in parallel with each other. The first and second center bypass lines CL1 and CL2 have respective downstream ends, each of which is blocked. The first and second tank lines TL1 and TL2 are merged with each other into a common tank line TLC to be communicable with the tank through the common tank line TLC. The common tank line TLC is provided with a back pressure valve 48.

The direction selector valves 14 to 18 are provided for the plurality of hydraulic actuators provided in the working machine (namely, five actuators including the boom cylinder 6, the arm cylinder 7, and the option cylinder 8), respectively, each serving as a control valve operable to control the supply of hydraulic fluid to the hydraulic actuator corresponding to the control valve. Among the direction selector valves 14 to 18, the direction selector valves 14, 15, and 16 are disposed along the first center bypass line CL1 and the direction selector valves 17 and 18 are disposed along the second center bypass line CL2.

Furthermore, this circuit includes a first parallel line for supplying hydraulic fluid discharged from the first pump 11 to the direction selector valves 14, 15, and 16 in parallel with each other, separately from the first center bypass line CL1. The first parallel line includes a common fluid line 21 branching from the first center bypass line CL1 and branch fluid lines 24, 25, and 26 branching from the common fluid line to reach the direction selector valves 14, 15, and 16, respectively. Similarly, this circuit includes a second parallel line for supplying hydraulic fluid discharged from the second pump 12 to the direction selector valves 17 and 18, separately from the second center bypass line CL2. The second parallel line includes a common fluid line 22 branching from the second center bypass line CL2 and branch fluid lines 27 and 28 branching from the common fluid line to reach the direction selector valves 17 and 18, respectively.

Each of the direction selector valves 14 to 18 in this embodiment is formed of a three-position hydraulic pilot-operated selector valve, having a neutral position and first and second drive positions on both sides of the neutral position. When being at the neutral position, each of the direction selector valves 14 to 18 opens the corresponding center bypass line CL1 or CL2 while blocking the corresponding actuator from the corresponding hydraulic pump and the tank. When shifted to the first drive position, each of the direction selector valves 14 to 18 leads hydraulic fluid supplied through the corresponding one of the branch fluid lines 24 to 28 to the corresponding actuator so as to manipulate the actuator in a first direction. When being at the second drive position, each of the direction selector valves 14 to 18 leads hydraulic fluid supplied through the corresponding one of the branch fluid lines 24 to 28 to the corresponding actuator so as to manipulate the actuator in a second direction opposite to the first direction.

In this embodiment, the arm cylinder 7 and the optional cylinder 8 correspond to "a main actuator" and "an optional actuator" according to the present invention, respectively, and the direction selector valves 14, 15 and 17 correspond to "a first main control valve", "an optional control valve", and "a second main control valve" according to the present invention, respectively. Besides, the common fluid line 21 and the branch fluid line 24 constitute an upstream portion of a first main supply fluid line according to the present invention; the common fluid line 21 and the branch fluid line 25 constitute an upstream portion of an optional supply fluid line according to the present invention; and the common fluid line 22 and the branch fluid line 27 constitute an upstream portion of a second main supply fluid line according to the present invention.

The direction selector valve 14 includes a pair of pilot ports 14*a* and 14*b*, be configured:

(i) to be held at the neutral position to block the arm cylinder 7 from the first pump 11 and the tank (i.e., block the first main supply fluid line), when no pilot pressure is input to the pilot ports 14*a* and 14*b;*

(ii) to be shifted to the first drive position to connect the branch fluid line 24 to a head-side fluid line 7*a* leading to a head-side chamber of the arm cylinder 7 and connect a rod-side fluid line 7*b* leading to a rod-side chamber of the arm cylinder 7 to the first tank line TL1, when a pilot pressure is input to the pilot port 14*a*; and (iii) to be shifted to the second drive position to connect the branch fluid line 24 to the rod-side fluid line 7*b* and connect the head-side fluid line 7*a* to the first tank line TL1, when a pilot pressure is input to the pilot port 14*b*.

Similarly, the direction selector valve 15 includes a pair of pilot ports 15*a* and 15*b*, being configured:

(i) to be held at the neutral position to block the optional cylinder 8 from the first pump 11 and the tank (i.e., block the optional supply fluid line), when no pilot pressure is input to the pilot ports 15*a* and 15*b;*

(ii) to be shifted to the first drive position to connect the branch fluid line 25 to a head-side fluid line 8*a* leading to a head-side chamber of the optional cylinder 8 and connect a rod-side fluid line 8*b* leading to a rod-side chamber of the optional cylinder 8 to the first tank line TL1, when a pilot pressure is input to the pilot port 15*a*; and (iii) to be shifted to the second drive position to connect the branch fluid line 25 to the rod-side fluid line 8*b* and connect the head-side fluid line 8*a* to the first tank line TL1, when a pilot pressure is input to the pilot port 15*b*.

Similarly, the direction selector valve 17 includes a pair of pilot ports 17*a* and 17*b*, being configured:

(i) to be held at the neutral position (at the central position as shown in the drawing) to block the arm cylinder 7 from the second pump 12 and the tank (i.e., block the second main supply fluid line), when no pilot pressure is input to the pilot ports 17*a* and 17*b;*

(ii) to be shifted to the first drive position to connect the branch fluid line 27 to a head-side fluid line 7*c* merging with the head-side fluid line 7*a* and connect a rod-side fluid line 7*d* merging with the rod-side fluid line 7*b* to the second tank line TL2, when a pilot pressure is input to the pilot port 17*a*; and (iii) to be switched to the second drive position to connect the branch fluid line 27 to the rod-side fluid line 7*d* and connect the head-side fluid line 7*c* to the second tank line TL2, when a pilot pressure is input to the pilot port 17*b*.

The arm manipulating device 31, which is used by an operator to manipulate the arm cylinder 7, corresponds to a main manipulating device according to the present invention, including an arm control lever 31*a* and an arm remote control valve 31*b*.

The arm control lever 31*a* is an operation member to which an arm control operation is applied by an operator, the arm control operation being a rotational operation of the arm control lever 31*a* for manipulating the arm cylinder 7. Specifically, the arm control lever 31*a* is pivotally connected to the arm remote control valve 31*b* to allow an operator to operate the arm control lever 31*a* from its neutral position to both sides thereof and vice versa, i.e., to be capable of receiving an arm drawing control operation and an arm pushing control operation. The atm pushing control operation corresponds to "a specific main control operation" for contracting the arm cylinder 7 so as to displace the optional device 3 in a direction having an upward component against the force of gravity acting on the optional device 3, the contracting action of the arm cylinder 7 corresponding to "a specific action" performed in response to the specific main control operation.

The arm remote control valve 31*b* supplies pilot pressure output by the pilot pump 13 to the direction selector valves 14 and 17 in accordance with the operation position of the arm control lever 31*a*. Specifically, when the arm control lever 31*a* is at the neutral position, the remote control valve 31*b* supplies no pilot pressure. When the arm control lever 31*a* is operated to move to the arm-drawing side, the arm remote control valve 31*b* supplies a pilot pressure having a magnitude corresponding to the operation amount of the arm control lever 31*a* to the pilot ports 14*a* and 17*a* of the direction selector valves 14 and 17 through the pilot lines 34A and 37A mutually branching off, respectively. When the arm control lever 31*a* is operated to move to the arm pushing side, the arm remote control valve 31*b* supplies a pilot pressure having a magnitude corresponding to the operation amount of the arm control lever 31*a* to the pilot ports 14*b* and 17*b* of the direction selector valves 14 and 17 through the pilot lines 34B and 37B mutually branching off, respectively.

The optional manipulating device 32, which is used by an operator to manipulate the optional cylinder 8, includes an optional control lever 32*a* and an optional remote control valve 32*b*. The optional control lever 32*a* is an operation member to which an optional control operation is applied by an operator, the optional control operation being a rotational operation of the optional control lever 32*a* for manipulating the optional cylinder 8. The optional control lever 32*a* is pivotally connected to the optional remote control valve 32*b* to allow an operator to operate the optional control lever 32*a* from its neutral position to both side thereof and vice versa by an operator (in this embodiment, to respective sides for opening and closing the nipping type of crusher and vice versa).

The optional remote control valve 32*b* supplies a pilot pressure output by the pilot pump 13 to the direction selector valve 15 in accordance with the operation position of the optional control lever 32*a*. Specifically, when the optional control lever 32*a* is at the neutral position, the optional remote control valve 32*b* supplies no pilot pressure. When the optional control lever 32*a* is operated to move to the side for closing the nipping type of crusher, the optional remote control valve 32*b* supplies a pilot pressure having a magnitude corresponding to the operation amount of the optional control lever 32*a* to the pilot port 15*a* of the direction selector valve 15 through the pilot line 35A. When the optional control lever 32*a* is operated to move to the side for opening the nipping type of crusher, the optional remote control valve 32*b* supplies a pilot pressure having a magnitude corresponding to the operation amount of the optional control lever 32*a* to the pilot port 15*b* of the direction selector valve 15 through the pilot line 35B.

The first and second tank lines TL1 and TL2 bring respective discharge ports of the first and second pumps 11 and 12 into communication with the tank through respective paths bypassing the center bypass lines CL1 and CL2, respectively. The first bleed-off control valve 41 and the second bleed-off control valve 42 are disposed in respective upstream ends of the first and second tank lines TL1 and TL2.

The first and second bleed-off control valves 41 and 42 are formed of respective electromagnetic valves including respective solenoids 41*a* and 42*a*. When no bleed-off instruction signal is input to the solenoid 41*a*, the first bleed-off control valve 41 is held at a closed position for blocking the first tank line TL1. When a bleed-off instruction signal is input to the solenoid 41*a*, the first bleed-off control valve 41 opens in such a way as to increase the opening area thereof in proportion to the intensity of the input bleed-off instruction signal to thereby open the first tank line TL1, i.e., to thereby increase the first bleed-off flow rate which is the flow rate of a part of hydraulic fluid discharged from the first pump 11 and directly returned to the tank through the first tank line TL1 without being supplied to any hydraulic actuator. When no bleed-off instruction signal is input to the solenoid 42*a*, the second bleed-off control valve 42 is held at a closed position for blocking the second tank line TL2. When a bleed-off instruction signal is input to the solenoid 42*a*, the second bleed-off control valve 42 opens in such a way as to increase the opening area thereof in proportion to the intensity of the input bleed-off instruction signal to thereby open the second tank line TL2, i.e., to thereby increase the second bleed-off flow rate which is the flow rate of hydraulic fluid discharged from the second pump 12 and directly returned to the tank through the second tank line TL2 without being supplied to any hydraulic actuator.

The merging selector valve 44 and the merging check valve 46 are capable of being switched between a state of allowing hydraulic fluid discharged from the second pump 12 and flowed in the second common fluid line 22 to merge into hydraulic fluid discharged from the first pump 11 and flowed in the first common fluid line 21 and a state of inhibit the hydraulic fluid from merging.

Specifically, the circuit is provided with a merging fluid line 23 disposed between the first and second common fluid lines 21 and 22 to allow communication therebetween, and the merging selector valve 44 and the merging check valve 46 are disposed in the merging fluid line 23 in series. The merging selector valve 44 is forming of a two-position electromagnetic selector valve including a solenoid 44*a* and configured to be held at a closed position (merging prevention position) to block the merging fluid line 23 when no merging instruction signal is input to the solenoid 44*a* and to be shifted to an open position (merging permission position) to open the merging fluid line 23 when a merging instruction signal is input to the solenoid 44*a*. The merging check valve 46 is configured to prevent hydraulic fluid from backflow from the first common fluid line 21 to the second common fluid line 22 when the merging selector valve 44 is shifted to the open position.

The system shown in FIG. 1 includes, in addition to the above-described components, a plurality of pressure sensors disposed in the circuit and a controller 60 that performs arithmetic and control operations based on detection signals generated and input thereto by the pressure sensors.

The plurality of pressure sensors include: a first pressure sensor 51 that detects the discharge pressure of the first pump 11, namely, a first pump pressure; a second pump pressure sensor 52 that detects the discharge pressure of the second pump 12, namely, a second pump pressure; a pair of arm pilot pressure sensors 53A and 53B that detect a head-side pilot pressure (an arm-drawing-side pilot pressure) and a rod-side pilot pressure (an arm-pushing-side pilot pressure), respectively, the head-side and rod-side pilot pressures being output by the arm manipulating device 31; and a pair of optional pilot pressure sensors 54A and 54B that detect a head-side pilot pressure (a closed-side pilot pressure in the case of the nipping type of crusher) and a rod-side pilot pressure (an open-side pilot pressure in the case of the nipping type of crusher), respectively, the head-side and rod-side pressures being output by the optional manipulating device 32.

Figure 3:
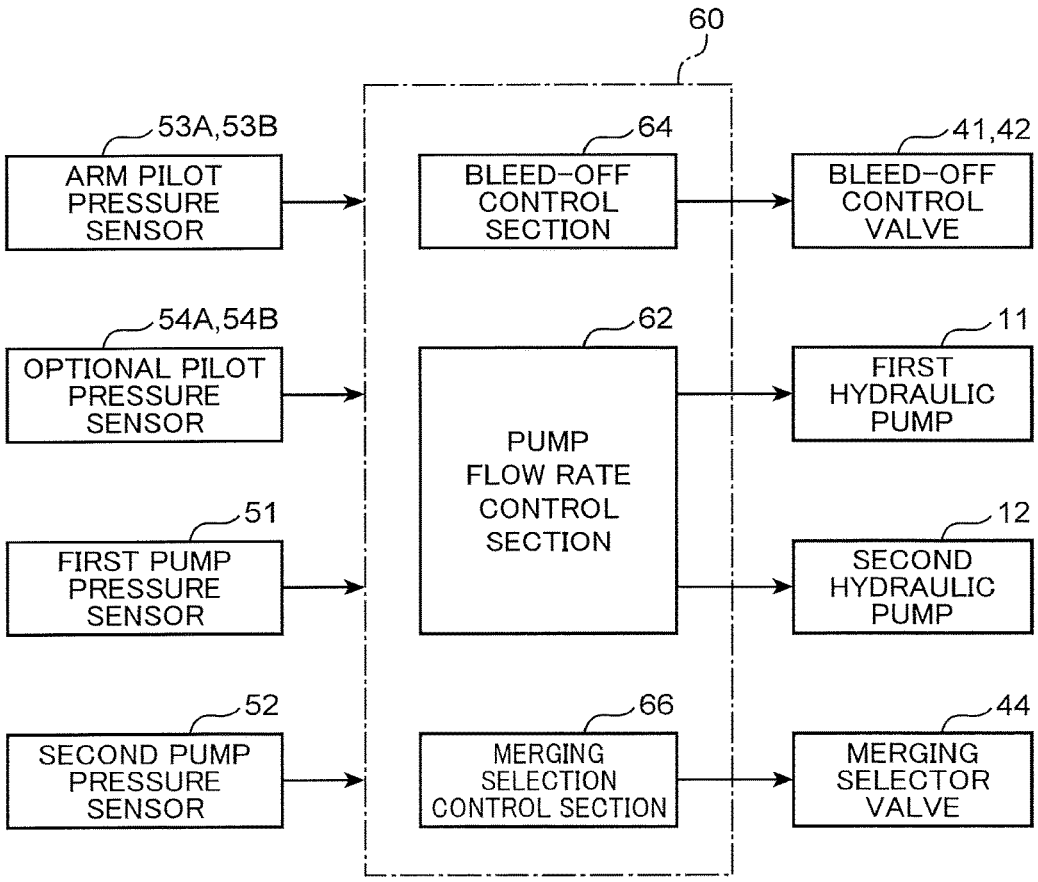
FIG. 3 is a block diagram showing a function of a controller of the hydraulic drive system and input and output signals to and from the controller.

The controller 60 comprises, for example, a computer, having a plurality of functions relating to the present invention, namely, a pump flow rate control section 62, a bleed-off control section 64 and a merging selection control section 66, as shown in FIG. 3. These sections perform respective controls of the pump flow rate, the bleed-off flow rate, and the merging switch, as described below.

(A) Pump Flow Rate Control

The pump flow rate control section 62 generates displacement-volume instruction signals with respect to the first and second pumps 11 and 12 in accordance with an arm control operation and an optional control operation applied to the arm manipulating device 31 and the optional manipulating device 32, respectively, and inputs the generated displacement-volume instruction signals to the regulators 11*a* and 12*a*, respectively, to change respective displacement volumes of the first and second pumps 11 and 12, thereby controlling the discharge flow rates of the first and second pumps 11 and 12, namely, the first and second pump flow rates.

Specifically, in an single optional manipulation state where no arm control operation is applied to the arm manipulating device 31 while an optional control operation is applied to the optional manipulating device 32, the pump flow rate control section 62 increases or reduces respective displacement volumes of the first and second pumps 11 and 12 in accordance with a control operation (optional control operation) applied to the optional manipulating device 32, based on a predetermined optional pump flow rate characteristic, to thereby increase or reduce the discharge flow rates of the first and second pumps 11 and 12, namely, the first and second pump flow rates.

Figure 4:
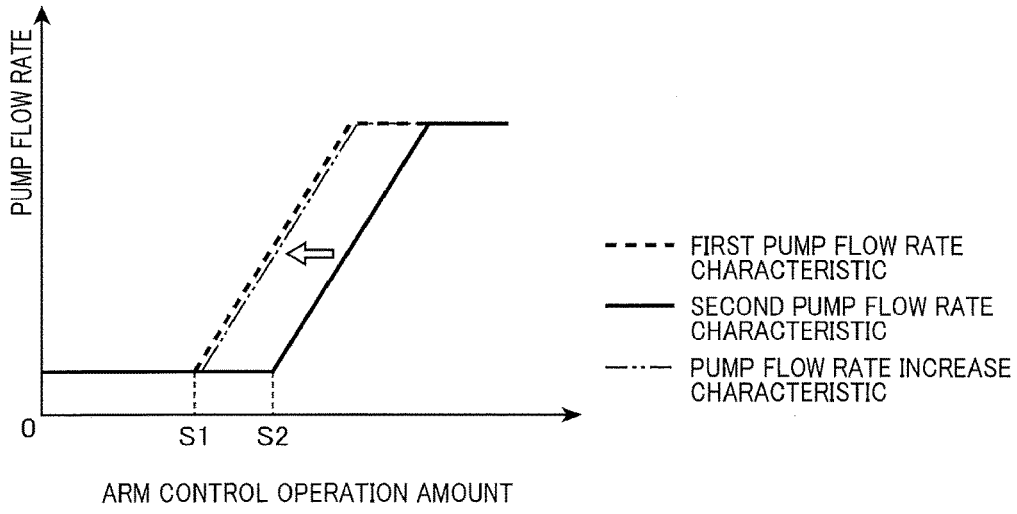
FIG. 4 is a graph showing a relationship between an arm control operation applied to an arm manipulating device and the respective pump flow rates of first and second pumps controlled by the controller in accordance with the arm control operation in the hydraulic drive system.

On the other hand, in a single arm manipulation state where no optional control operation is applied to the optional manipulating device 32 while an arm control operation is applied to the arm manipulating device 31, the pump flow rate control section 62 increases or reduces respective displacement volumes of the first and second pumps 11 and 12 in accordance with the control operation applied to the arm manipulating device 31 (that is, an arm control operation or a main control operation) based on a first pump flow rate characteristic and a second pump flow rate characteristic indicated by the solid line and the broken line shown in FIG. 4, respectively. In this embodiment, the first pump flow rate characteristic is determined so as to maintain the first pump flow rate at a minimum value under the condition where the arm control operation amount, i.e., the amount of the arm control operation applied to the arm control lever 31*a* of the arm manipulating device 31, is less than a predetermined first control operation amount S1 and so as to increase the first pump flow rate up to a maximum value with increase in the arm control operation amount under the condition where the arm control operation amount is equal to or greater than the first control operation amount S1. The second pump flow rate characteristic is determined so as to maintain the second pump flow rate at the minimum value under the condition where the arm control operation amount is less than a predetermined second control operation amount S2 and so as to increase the second pump flow rate up to the maximum value with increase in the arm control operation amount under the condition where the arm control operation amount is equal to or greater than the second control operation amount S2.

In the above characteristics, respective gradients of the first pump flow rate and the second pump flow with respect to the arm control operation amount arc set to be equal to each other, whereas the second control operation amount S2 which is the increase starting point at which the second pump flow rate starts increasing with increase in the arm control operation amount is set to be greater than the first control operation amount S1 which is the increase starting point at which the first pump flow rate starts increasing with increase in the arm control operation amount. Accordingly, in this embodiment, the first and second pump flow rate characteristics are so set that the second pump flow rate is less than the first pump flow rate for the same arm control operation amount.

Furthermore, the system has a feature that the pump flow rate control section 62 is configured to make the displacement volume of the second pump 12 corresponding to an arm control operation applied to the arm manipulating device 31 in a specific combined manipulation state be greater than that in the single arm manipulation state where no optional control operation is applied to the optional manipulating device 32 while an arm control operation is applied to the main manipulating device 31. The specific combined manipulation state is a state where an arm pushing control operation for bringing the arm cylinder 7 as the main actuator in this embodiment into contracting action corresponding to the specific action, namely, arm pushing action, is applied to the arm manipulating device 31, and the optional control operation for operating the optional cylinder 8 as the optional actuator is applied to the optional manipulating device 32, simultaneously.

Specifically, the pump flow rate control section 62 according to this embodiment is configured to increase or decrease the second pump flow rate, in the specific combined manipulation state, based on a pump-flow-rate increase characteristic equivalent to or similar to the first pump flow rate characteristic, as indicated by the two-dot chain line in FIG. 4, in place of the second pump flow rate characteristic indicated by the solid line in FIG. 4. This results in that the control of the second pump flow rate based on the pump-flow-rate increase characteristic corresponds to the control of making the second pump flow rate be greater than that determined based on the second pump flow rate characteristic in the single arm manipulation state.

Besides, the pump flow rate control to be performed when an optional control operation and an arm drawing control operation (a control operation for extending the arm cylinder 7 to actuate the arm 5 in a drawing direction) are simultaneously performed is not limited. For example, it is also permissible to calculate the first pump flow rate as the sum of two pump flow rate: one is calculated based on the amount of an optional control operation and the optional pump flow rate characteristic, and the other is calculated based on an arm control operation amount and the first pump flow rate characteristic.

(B) Bleed-off Control

The Bleed-Off Control Section 64 Generates a First Bleed-Off Instruction Signal and a second bleed-off instruction signal based on an arm control operation and an optional control operation applied to the arm manipulating device 31 and the optional manipulating device 32, respectively, and inputs these signals to respective solenoids 41*a* and 42*a* of the first bleed-off control valve 41 and the second bleed-off control valve 42, thereby changing respective opening areas of the first and second bleed-off control valves 41 and 42 to control the first bleed-off flow rate through the first tank line TL1 and the second bleed-off flow rate through the second tank line TL2, respectively.

Specifically, in the single optional manipulation state, the bleed-off control section 64 reduces respective opening areas of the first and second bleed-off control valves 41 and 42 with increase in the amount of a control operation (optional control operation) applied to the optional manipulating device 32 (namely, optional manipulation amount), based on a predetermined optional bleed-off characteristic, thereby reducing the first and second bleed-off flow rates.

Figure 5:
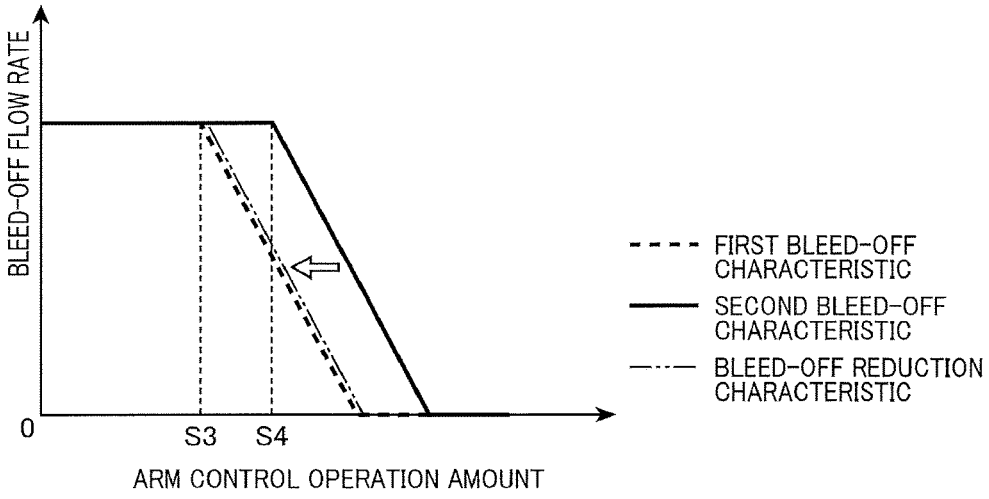
FIG. 5 is a graph showing a relationship between the amount of an arm control operation and first and second bleed-off flow rates controlled by the controller in accordance with the amount of the arm control operation.

On the other hand, in the single arm manipulation state, the bleed-off control section 64 reduces the first and second bleed-off control flow rates in accordance with the control operation (the arm control operation or the main control operation) applied to the arm manipulating device 31, based on a first bleed-off characteristic and a second bleed-off characteristic indicated by the solid line and the broken line shown in FIG. 5, respectively. Specifically, the first bleed-off characteristic is a characteristic where the first bleed-off flow rate is maintained at a maximum value under the condition where the arm control operation amount is less than a predetermined third control operation amount S3 and the first bleed-off flow rate decreases to zero (so that the first bleed-off control valve is fully closed) with increase in the arm control operation amount under the condition where the arm control operation amount is equal to or greater than the third control operation amount S3. The second bleed-off characteristic is a characteristic where the second bleed-off flow rate is maintained at the maximum value under the condition where the arm control operation amount is less than a predetermined fourth control operation amount S4 and the second bleed-off flow rate decreases to zero (so that the second bleed-off control valve is fully closed) with increase in the control operation amount under the condition where the arm control operation amount is equal to or greater than the fourth control operation amount S4.

Respective gradients of the first bleed-off flow rate and the second bleed-off flow rate with respect to the arm control operation amount are set to be equal to each other, whereas the third control operation amount S3 which is the decrease starting point at which the bleed-off flow rate starts decreasing with increase in the arm control operation amount is set to be smaller than the fourth control operation amount S4 which is the decrease starting point at which the second bleed-off flow rate starts decreasing with increase in the arm control operation amount. Accordingly, in this embodiment, the first and second bleed-off characteristics are so set that the second bleed off flow rate is greater than the first bleed-off flow rate for the same control operation amount.

Furthermore, the system has a feature that the bleed-off control section 64 is configured to make the opening area of the second bleed-off control valve 42 corresponding to the arm control operation applied to the arm manipulating device 31 in the specific combined manipulation state be smaller than that in the single arm manipulation state to make the second bleed-off flow rate be smaller.

Specifically, the bleed-off control section 64 according to this embodiment is configured to control the second bleed-off flow rate, in the specific combined manipulation state, based on a bleed-off reduction characteristic equivalent to or similar to the first bleed-off characteristic as indicated by the two-dot chain line in FIG. 5, in place of the second bleed-off flow rate characteristic. This results in that the control of the second bleed-off flow rate based on the bleed-off reduction characteristic corresponds to the control of making the second bleed-off flow rate be smaller than the second bleed-off flow rate that is set based on the second bleed-off flow rate characteristic in the single arm manipulation state.

Besides, the bleed-off flow rate control to be performed when an optional control operation and an arm drawing control operation are simultaneously performed is also not limited. For example, it is also permissible to select, as the first bleed-off flow rate, a greater one from two flow rates: one is a bleed-off flow rate calculated based on the optional control operation amount and the optional bleed-off flow rate characteristic and the other is a bleed-off flow rate calculated based on an arm control operation amount and the first bleed-off flow rate characteristic.

(C) Merging Selection Control

In the single optional manipulation state, that is, the state where no control operation is applied to the arm manipulating device 31 while a control operation is applied to the optional manipulating device 32, the merging selection control section 66 inputs a merging instruction signal to the solenoid 44*a* of the merging selector valve 44 to open the merging selector valve 44, that is, to allow hydraulic fluid discharged from the second pump 12 to merge into hydraulic fluid discharged from the first pump 11, whereas, at least in the specific combined manipulation state (in this embodiment, in a state other than the single optional manipulation state), the merging selection control section 66 stops the input of merging instruction signal to close the merging selector valve 44, that is, to hinder the merging.

Next will be described the specific controls performed by the controller 60 and the action of the system accompanying the controls.

In the single optional manipulation state where no arm control operation is applied to the atm manipulating device 31 while an optional control operation is applied to the optional manipulating device 32, the merging selection control section 66 causes the merging selector valve 44 to open to thereby allow hydraulic fluid discharged from the second pump 12 to merge into hydraulic fluid supplied from the first pump 11 to the optional cylinder 8, while the pump flow rate control section 62 and the bleed-off control section 64 control the first and second pump flow rates and the first and second bleed-off flow rates based on the optional pump flow rate characteristic and the optional bleed-off characteristic, respectively. These controls cause the optional cylinder 8 to be driven at a driving speed corresponding to the optional control operation, the driving speed being increased by combination of the first and second pump flow rates.

In contrast, in the single arm manipulation state where no control operation is applied to the optional manipulating device 32 while a control operation is applied to the arm manipulating device 31, the pump flow rate control section 62 changes respective displacement volumes of the first and second pumps 11 and 12 in accordance with the arm control operation amount, based on the first pump flow rate characteristic and the second pump flow rate characteristic indicated by the solid line and the broken line shown in FIG. 4, respectively, while the bleed-off control section 64 increases or reduces the first and second bleed-off flow rates in accordance with the arm control operation amount, based on the first bleed-off characteristic and the second bleed-off characteristic indicated by the solid line and the broken line shown in FIG. 5, respectively. Although the merging selection control section 66 closes the merging selector valve 44 to hinder the merging, hydraulic fluid discharged from the first pump 11 and hydraulic fluid discharged from the second pump 12 are supplied to the arm cylinder 7 through the first main supply fluid line (fluid line passing through the direction selector valve 14) and the second main supply fluid line (fluid line passing through the direction selector valve 17) independently of each other, so that the arm cylinder 7 is driven by hydraulic fluid discharged from both the first pump 11 and the second pump 12.

In the specific combined manipulation state where an arm pushing control operation for bringing the arm cylinder 7 into contracting action corresponding to the arm pushing action is applied to the arm manipulating device 31 and an optional control operation for driving the optional cylinder 8 is applied to the optional manipulating device 32, simultaneously, the merging selection control section 66 closes the merging selector valve 44 to cut off the communication between the first main supply fluid line and the second main supply fluid line, while the pump flow rate control section 62 makes the displacement volume of the second pump 12 corresponding to the arm control operation amount be greater than that in the single arm manipulation state (specifically, the characteristic of the second pump flow rate corresponding to the arm control operation amount is changed from the second pump flow rate characteristic indicated by the solid line in FIG. 4 to the pump-flow-rate increase characteristic indicated by the two-dot chain line in FIG. 4) and the bleed-off control section 64 makes the second bleed-off flow rate corresponding to the arm control operation amount be smaller than that in the single arm manipulation state (specifically, the characteristic of the second bleed-off flow rate corresponding to the arm control operation amount is changed from the second bleed-off characteristic indicated by the solid line in FIG. 5 to the bleed-off flow rate reduction characteristic indicated by the two-dot chain line in FIG. 5).

This control makes it possible to secure a stable flow rate of hydraulic fluid supplied to the arm cylinder 7, regardless of the flow rate of hydraulic fluid flowing in the optional cylinder 8. Specifically, in the specific combined manipulation state, much of hydraulic fluid discharged from the first pump 11 flows into the optional cylinder 8 for driving the optional cylinder 8 which requires a smaller load than the arm cylinder 7, thereby significantly reducing the flow rate of hydraulic fluid flowing into the arm cylinder 7, while the discharge flow rate (pump flow rate) of the second pump 12 is increased and the second bleed-off flow rate is reduced, which increases the flow rate of hydraulic fluid supplied from the second pump 12 to the arm cylinder 7 through the direction selector valve 17. This biases hydraulic respective fluid supplies from the first pump 11 and the second pump 12 are biased to the optional cylinder 8 and the arm cylinder 7, respectively. This effectively suppresses the influence by the flow rate of hydraulic fluid flowing from the first pump 11 to the optional cylinder 8 upon the total flow rate of hydraulic fluid supplied to the arm cylinder 7, thereby stabilizing the flow rate of hydraulic fluid supplied to the arm cylinder 7.

Although the first and second bleed-off flow rates, in the above-described first embodiment, are regulated by the first and second bleed-off control valves 41 and 42 disposed in the first and second tank lines TL1 and TL2, respectively, the regulation of the first bleed-off flow rate is not absolutely required in the present invention. Besides, the regulation of the second bleed-off flow rate is not limited to one by the second bleed-off control valve 42. For example, in the case where the second main control valve (in FIG. 1, the direction selector valve 17) disposed in the second main supply fluid line includes a bleed-off flow path formation portion having an opening area variable according to the stroke of the second main control valve, the control of the second bleed-off flow rate (control for reducing the second bleed-off flow rate in the specific combined manipulation state) similarly to the first embodiment can be performed by the operation of the second main control valve.

An example of the above-mentioned case will be described as a second embodiment with reference to FIGS. 6 to 8. The system according to the second embodiment is as the same as the above-described system according to the first embodiment, except for the following differences (a) to (e).

(a) Tank Lines and Center Bypass Lines

The second embodiment does not require the following components included in the first embodiment: the first and second bleed-off control valves 41 and 42, and respective upstream portions of the first and second tank lines TL1 and TL2 with respective first and second bleed-off control valves 41 and 42. In other words, the second embodiment involves first and second tank lines TL1 and TL2 which are independent of first and second center bypass lines CL1 and CL2, respectively.

On the other hand, respective downstream ends of the first and second center bypass lines CL1 and CL2 merge with the first and second tank lines TL1 and TL2 into a common tank line 48, thus being allowed to communicate with a tank through the common tank line 48.

(b) Pilot Line

Figure 6:
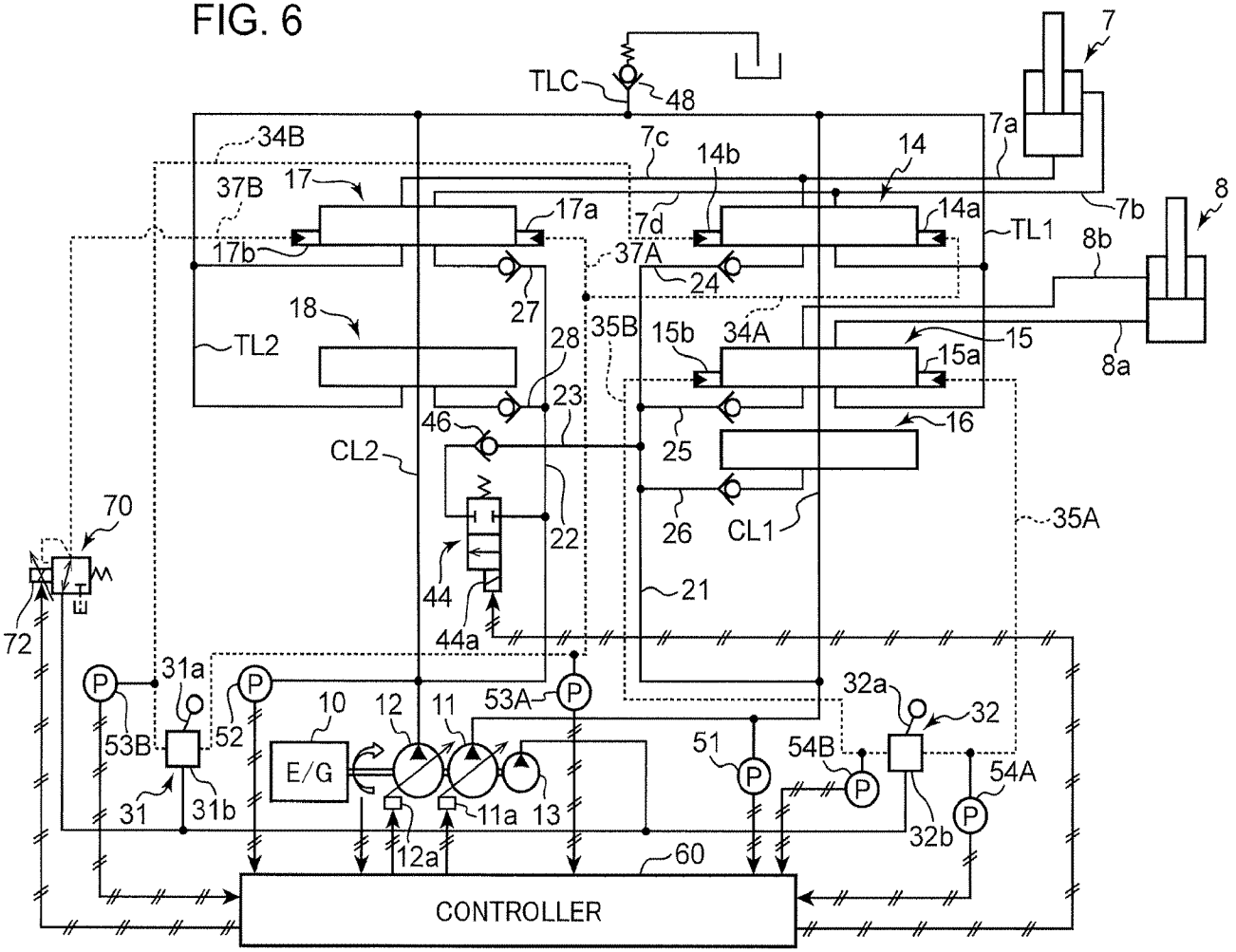
FIG. 6 is a circuit diagram of a hydraulic drive system according to a second embodiment of the present invention.

The second embodiment also involves a direction selector valve 17 with a pair of pilot ports 17*a* and 17*b*; however, a pilot line 37B leading to the pilot port 17*b* for arm pushing is arranged, as shown in FIG. 6, in such a manner as to connect the pilot port 17*b* not to an outlet port of a remote control valve 31*b* of an arm manipulating device 31 but to a discharge port of a pilot pump 13 directly.

(c) Direction Selector Valves

Each of direction selector valves 14 to 18 includes a bleed-off flow path forming portion, that is, a portion forming a bleed-off flow path for returning hydraulic fluid, which is supplied from a first pump 11 or a second pump 12 to the direction selector valve, to a tank directly through the first tank line TL1 or the second tank line TL2 so as to bypass a corresponding hydraulic actuator. For example, the direction selector valve 17 corresponding to the second main control valve includes, as the bleed-off flow path forming portion, a portion forming a bleed-off flow path for returning hydraulic fluid supplied from the second pump 12 to the direction selector valve 17 to the tank directly through the second tank line TL2 so as to bypass an arm cylinder 7. Furthermore, the bleed-off flow path in each of the direction selector valves 14 to 18 is formed in such a manner as to have an opening area which is reduced with increase in the valve-opening stroke of the corresponding direction selector valve from its neutral position.

(d) Pilot Pressure Control Valve

The second embodiment further involves a pilot pressure regulating valve 70 disposed in the pilot line 37B for arm pushing manipulation, as shown in FIG. 6. The pilot pressure regulating valve 70 is formed of an electromagnetic proportional reducing valve including a solenoid 72, being operable to change its opening area in accordance with a pilot pressure instruction signal input to the solenoid 72 to thereby bring the secondary pressure of the pilot pressure regulating valve 70, namely, the pilot pressure input to the pilot port 17*b* for arm pushing, into correspondence with the pilot pressure instruction signal.

(e) Pilot Pressure Control Section

Figure 7:
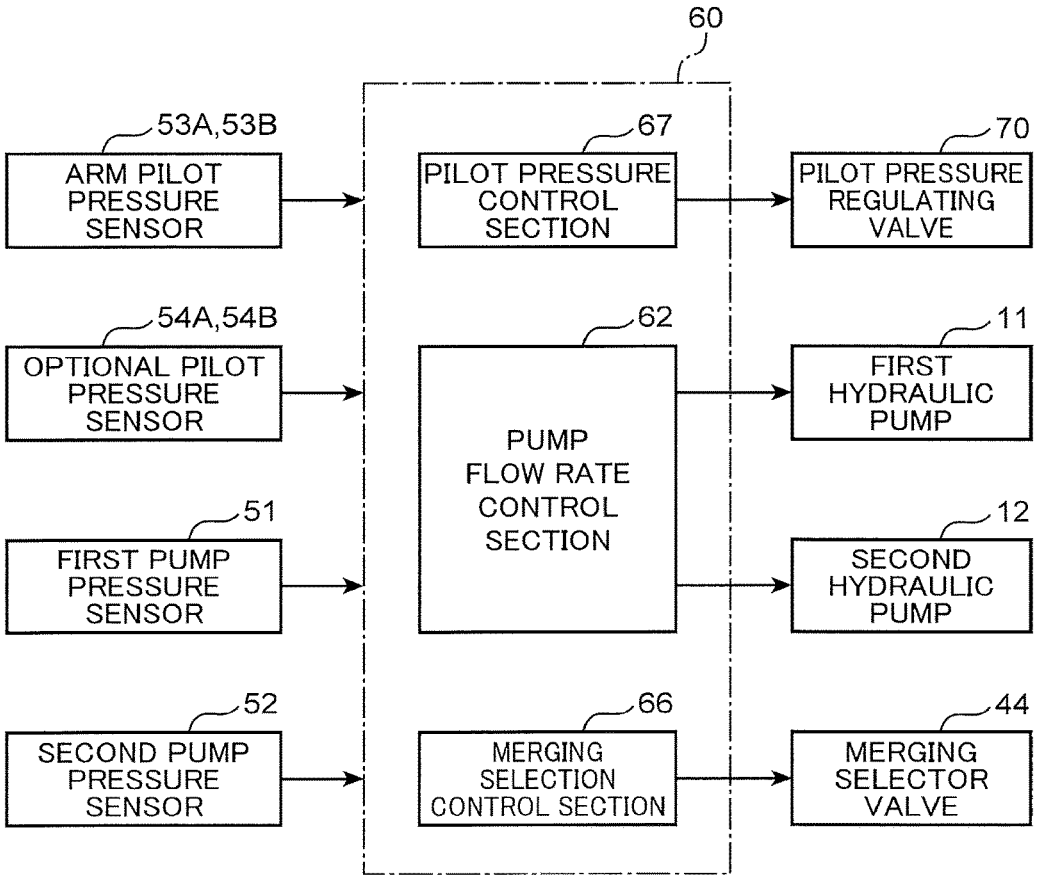
FIG. 7 is a block diagram showing a function of a controller of the hydraulic drive system according to the second embodiment and input and output signals to and from the controller.

The second embodiment also involves a controller 60, but it includes a pilot pressure control section 67 shown in FIG. 7 in place of the bleed-off control section 64 shown in FIG. 1. The pilot pressure control section 67 generates a pilot pressure instruction signal based on an arm control operation amount, and inputs the generated signal to the solenoid 72 of the pilot pressure regulating valve 70 to thereby change the secondary pressure of the pilot pressure regulating valve 70, i.e., the pilot pressure input to the pilot port 17*b* for arm pushing, in accordance with the arm control operation amount. Furthermore, the pilot pressure control section 67 controls the pilot pressure regulating valve 70 so as to make the pilot pressure corresponding to the arm control operation in the specific combined manipulation state than that in the single arm manipulation state.

Figure 8:
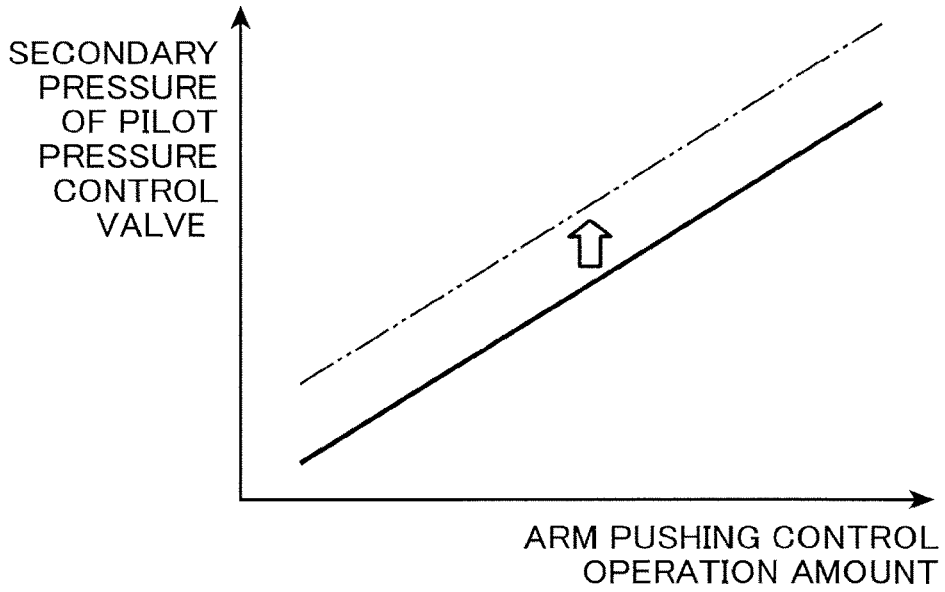
FIG. 8 is a graph showing a relationship between an arm control operation applied to an arm manipulating device of the hydraulic drive system shown in FIG. 7 and the secondary pressure of a pilot pressure control valve controlled by the controller in accordance with the arm control operation.
Figure 9:
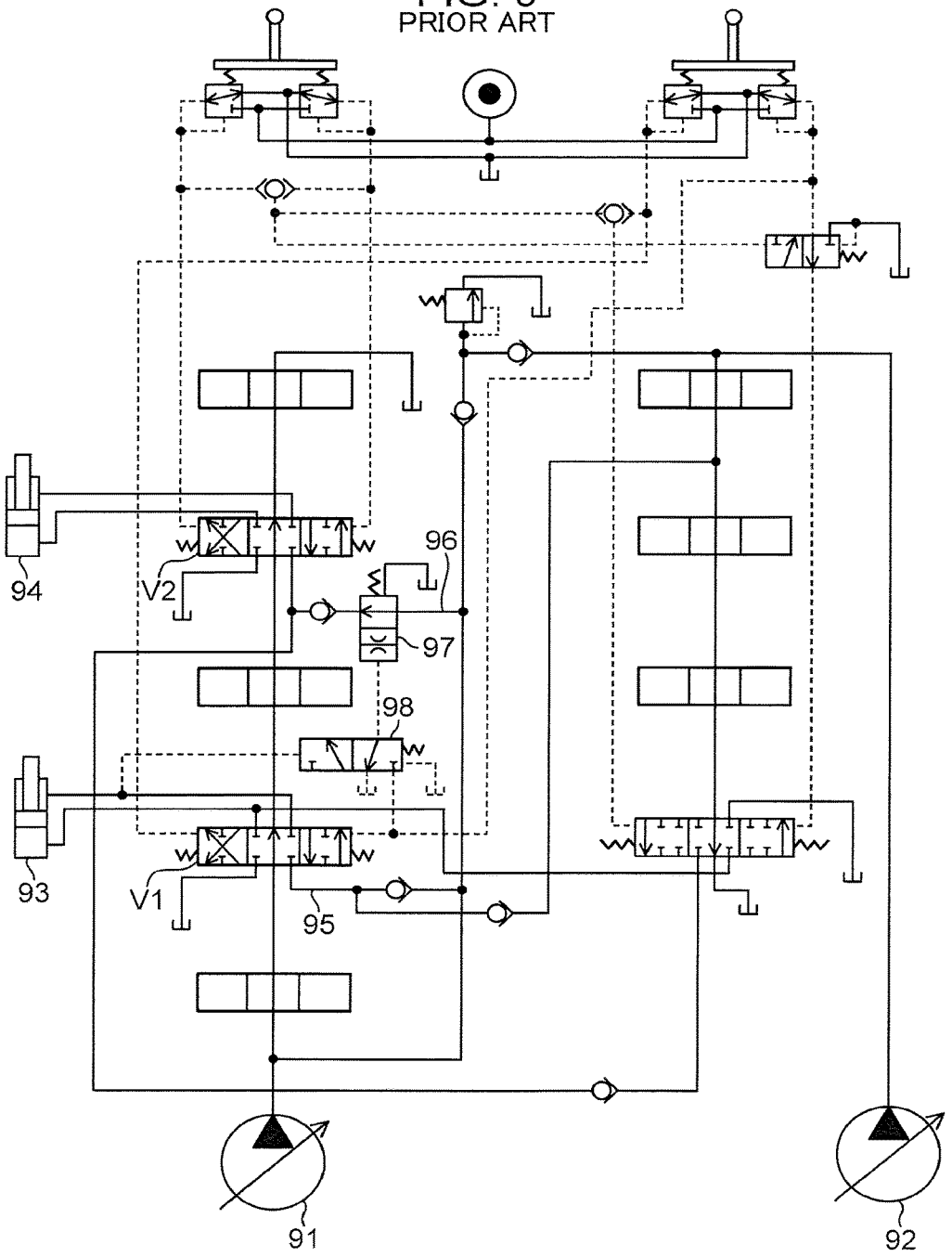
FIG. 9 PRIOR ART
FIG. 9 is a circuit diagram of a conventional hydraulic drive system for a working machine.

Specifically, in the single arm manipulation state, the pilot pressure control section 67 inputs to the solenoid 72 of the pilot pressure regulating valve 70 such a pilot pressure instruction signal as to bring the secondary pressure of the pilot pressure regulating valve 70 into substantial proportionality to the arm control operation amount, based on a normal characteristic indicated by the solid line in FIG. 8. On the other hand, in the specific combined manipulation state, the pilot pressure control section 67 inputs to the solenoid 72 of the pilot pressure regulating valve 70 such a pilot pressure instruction signal as to make the secondary pressure of the pilot pressure regulating valve 70 be greater than that in the single arm manipulation state by a specific amount, based on a pilot pressure increase characteristic indicated by the two-dot chain line in FIG. 8.

This control, involving making the pilot pressure input to the pilot port 17*b* be greater in the specific combined manipulation state than that in the single arm manipulation state to operate the direction selector valve 17 to an arm pushing control operation side at a relatively greater stroke, also makes it possible to reduce the opening area of the bleed-off flow path included in the direction selector valve 17 to suppress the second bleed-off flow rate, thereby allowing the flow rate of hydraulic fluid supplied from the second pump 12 to the arm cylinder 7 to be secured.

The present invention is not limited to the above-described first and second embodiments. The present invention encompasses, for example, the following modes.

(A) Regarding Pump Flow Rate

The present invention does not absolutely require the pump flow rate control. For example, even if the first and second pumps 11 and 12 according to the first and second embodiments are form of fixed displacement pumps with a constant discharge flow rate, it is also possible to increase the flow rate of hydraulic fluid supplied from the second pump 12 to the arm cylinder 7 to compensate for the reduction in the flow rate of hydraulic fluid supplied from the first pump 11 to the arm cylinder 7 by performing a control of making the second bleed-off flow rate in the specific combined manipulation state be smaller than that in the single main manipulation state (the single arm manipulation state).

In the case of performing pump flow rate control, the pump flow rate characteristics to be used are not limited to those shown in FIG. 4. For example, the discharge flow rate (pump flow rate) of the second pump also can be controlled in such a way as to increase in a curve with increase in the main control operation amount or the optional control operation amount.

Furthermore, the mode for setting the discharge flow rate of the second pump in the specific combined manipulation state to be greater than that in the single main manipulation state is also not limited to the one shown in FIG. 4. For example, determination of the greater discharge flow rate of the second pump also can be performed also by calculation of simply adding a predetermined increment to the second pump flow rate characteristic indicated by the solid line in FIG. 4 or by calculation of multiplying the second pump flow rate characteristic by a correction factor which is greater than one (>1). However, the use of the pump-flow-rate increase characteristic having the same gradient as the second pump flow rate characteristic but having an increase starting point of the second pump flow rate which point is shifted to a lower side in the atm control operation amount as indicated by the two-dot chain line in FIG. 4 makes it possible to secure a sufficient discharge flow rate of the second pump, for a small arm control operation amount, while alleviating sense of abnormality upon an operator.

(B) Regarding Bleed-off Flow Rate

The bleed-off characteristics used in the present invention are not limited to those shown in FIG. 5. For example, the second bleed-off flow rate also can be controlled in such a way as to decrease in a curve with increase in the main control operation amount or the optional control operation amount. Besides, the control of the first bleed-off flow rate is not absolutely required in the present invention.

Furthermore, the mode for determination of a smaller second bleed-off flow rate in the specific combined manipulation state than that in the single main manipulation state is not limited to the one shown in FIG. 5. For example, the determination of the smaller second bleed-off flow rate also can be performed by calculation of simply subtracting a predetermined decrement from the second bleed-off characteristic indicated by the solid line in FIG. 5 or by calculation of multiplying the second bleed-off characteristic by a correction factor smaller than one (<1). However, the use of the bleed-off reduction characteristic that has the same gradient as the second bleed-off characteristic but has the decrease starting point of the second bleed-off flow rate which point is shifted to a lower side in the arm control operation amount as indicated by the two-dot chain line in FIG. 5 makes it possible to secure a sufficient flow rate of hydraulic fluid supplied from the second pump corresponding to a small arm control operation amount to the main actuator, while alleviating sense of abnormality upon an operator.

(C) Regarding Merging Selection

The present invention does not absolutely require merging of hydraulic fluid through the merging fluid line 23. In other words, the present invention also permits the first main supply fluid line and the second main supply fluid line to be completely independent of each other. Besides, the merging selection, if performed, only has to meet the condition of allowing the merging in the single optional manipulation state while hindering the merging in the specific combined manipulation state; it is therefore selectable whether allowing or hindering the merging in the other states.

(D) Regarding Main Actuator and Specific Motion Thereof

The hydraulic actuator corresponding to the "main actuator" and the specific action thereof according to the present invention are not limited to the arm cylinder 7 and the action of the arm cylinder 7 in the arm pushing direction (namely, contracting action in the above-described embodiments). For example, it is also permissible that the boom cylinder 6 serves as the main actuator and its action in the boom raising direction (expanding action) corresponds to the specific action.

As described above, provided is a hydraulic drive system to be provided to a working machine including a working attachment and an optional device mounted on the working attachment, for hydraulically driving the working attachment and the optional device, the hydraulic drive system being capable of providing a stable flow rate of hydraulic fluid supplied to the main actuator, regardless of the flow rate of hydraulic fluid flowing in the optional actuator during simultaneous performance of a control operation for causing the main actuator to make a specific action and a control operation for operating the optional actuator.

Specifically, provided is a hydraulic drive system to be provided to a working machine including a working attachment having a distal end to which an optional device is mountable, for driving the working attachment and the optional device by hydraulic pressure, the hydraulic drive system comprising: a main actuator connected to the working attachment so as to actuate the working attachment by receiving a supply of hydraulic fluid; an optional actuator connected to the optional device so as to actuate the optional device by receiving a supply of hydraulic fluid; a first pump that discharges hydraulic fluid; a second pump that discharges discharging hydraulic fluid independently of the first pump; a first main supply fluid line for leading hydraulic fluid discharged from the first pump to the main actuator; an optional supply fluid line for leading hydraulic fluid discharged from the first pump to the optional actuator in parallel with the first main supply fluid line; a second main supply fluid line for leading hydraulic fluid discharged from the second pump to the main actuator through a different path from the first main supply fluid line; a main manipulating device to which a main control operation for manipulating the main actuator is applied; an optional manipulating device to which an optional control operation for manipulating the optional actuator is applied; a first main control valve operable to control the supply of hydraulic fluid to the main actuator through the first main supply fluid line in accordance with the main control operation applied to the main manipulating device; an optional control valve operable to control the supply of hydraulic fluid to the optional actuator through the optional supply fluid line in accordance with the optional control operation applied to the optional manipulating device; a second main control valve operable to control the supply of hydraulic fluid to the main actuator through the second main supply fluid line in accordance with the main control operation applied to the main manipulating device; a bleed-off fluid line for returning hydraulic fluid discharged from the second pump to a tank so as to bypass the main actuator; a bleed-off flow rate regulating section configured to regulate a bleed-off flow rate which is the flow rate of hydraulic fluid flowing in the bleed-off fluid line; and a bleed-off control section configured to control the bleed-off flow rate regulating section to make the bleed-off flow rate corresponding to the control operation applied to the main manipulating device in a specific combined manipulation state where a specific main control operation for bringing the main actuator into specific action is applied to the main manipulating device and an optional control operation for operating the optional actuator is applied to the main manipulating device, simultaneously, be smaller than the bleed-off flow rate corresponding to the control operation in a single main manipulation state where no optional control operation is applied to the optional manipulating device while a main control operation is applied to the main manipulating device.

This system, making the bleed-off flow rate of the second pump in the specific combined manipulation state, that is, in the state where an optional control operation for bringing the optional actuator into action and a specific main control operation for bringing the main actuator into the specific action are simultaneously applied to the optional manipulating device and the main manipulating device, respectively, be smaller than that in the single main manipulation state, that is, in the state where no control operation is applied to the optional manipulating device while a control operation is applied to the main manipulating device, allows a flow rate of hydraulic fluid supplied to the main actuator to be stably secured, regardless of the flow rate of hydraulic fluid flowing in the optional actuator. Specifically, in the specific combined manipulation state, the flow rate of hydraulic fluid supplied from the first pump to the main actuator for driving the optional actuator is significantly suppressed, while the flow rate of hydraulic fluid supplied from the second pump to the main actuator is increased because of the suppression of the bleed-off flow rate of the second pump; this biases the hydraulic fluid supply from the first and second pumps to the optional actuator and the main actuator, respectively, thus effectively suppressing the influence which is exerted by the flow rate of hydraulic fluid flowing from the first pump to the optional actuator upon the flow rate of hydraulic fluid supplied to the main actuator to thereby stabilize the flow rate of hydraulic fluid supplied to the main actuator.

Preferably, the system further includes a pump flow rate control section for making the discharge flow rate of the second pump be greater in the specific combined manipulation state than the discharge flow rate in the single main manipulation state. Thus determining a relatively great discharge flow rate of the second pump in the specific combined manipulation state further ensures the supply of hydraulic fluid to the main actuator at a stable flow rate, in cooperation with the reduction in the bleed-off flow rate.

The bleed-off flow rate regulating section preferably includes a bleed-off control valve disposed in the bleed-off fluid line, the bleed-of control valve including a signal input portion for receiving a bleed-off instruction signal and being operable to change the opening area of the bleed-of control valve in accordance with the bleed-off instruction signal input to the signal input portion. In addition thereto, it is preferable to configure the bleed-off control section to generate a bleed-off instruction signal in accordance with control operations applied to the main manipulating device and the optional manipulating device, respectively, and to input the generated bleed-off instruction signal to the signal input portion of the bleed-off control valve. This enables the bleed-off control section to control the bleed-off flow rate.

Alternatively, it is also possible that the bleed-off flow rate regulating section is a bleed-off flow path forming portion incorporated in the second main control valve so as to be located in an intermediate position of the bleed-off fluid line, the bleed-off flow path forming portion being formed so as to reduce the opening area thereof with an opening action of the second main control valve in a direction to increase the flow rate of hydraulic fluid supplied from the second pump to the main actuator to bring the main actuator into the specific action. In this case, the bleed-off control section can reduce the bleed-off flow rate by operating the second main control valve to open by a stroke corresponding to the main control operation applied to the main manipulating device and operating the second main control valve to open by a greater stroke in the specific combined manipulation state than a stroke of the second main control valve in the single main manipulation state, for the main control operation applied to the main manipulating device.

For example, in the case where the second main control valve is a pilot selector valve which receives a pilot pressure to open by a stroke corresponding to the input pilot pressure, it is preferable that the bleed-off control section includes: a pilot pressure regulating valve configured to change the pilot pressure input to the second main control valve to bring the main actuator into the specific action; and a pilot pressure control section configured to operate the pilot pressure regulating valve so as to change the pilot pressure in accordance with the main control operation applied to the main manipulating device and so as to make the pilot pressure in the specific combined manipulation state be greater than the pilot pressure in the single manipulation state, for the main control operation applied to the main manipulating device.

It is preferable that the system further includes: a merging fluid line for merging a part of hydraulic fluid discharged from the second pump into hydraulic fluid discharged from the first pump; a merging selector valve configured to be switched between a state of blocking the merging fluid line and a state of opening the merging fluid line; and a merging selection control section configured to operate the merging selector valve to open the merging fluid line in an single optional manipulation state where no control operation is applied to the main manipulating device while a control operation is applied to the optional manipulating device and to operate the merging selector valve to block the merging fluid line in the specific combined manipulation state. In the single optional manipulation state, the merging selection control section can increase the driving speed of the optional actuator by opening the merging fluid line, while, in the combined manipulation state, the merging selection control section can prevent hydraulic fluid flowing in the second main supply fluid line for driving the optional actuator from flowing into the optional actuator's side to decrease the flow rate of hydraulic fluid supplied to the main actuator through the second main supply fluid line, by blocking the merging fluid line.

The "specific action" performed by the main actuator can be appropriately selected in accordance with the design of the working machine. For example, the "specific action" can be an action of displacing the optional device in a direction having an upward component against the force of gravity acting on the optional device (for example, an action for actuating an arm as described above in a pushing direction); this makes it possible to secure a flow rate of hydraulic fluid necessary to be supplied to the main actuator to actuate the working attachment against the force of gravity acting on the optional device, even when much of hydraulic fluid discharged from the first pump is brought into actuate the optional device, by increasing the flow rate of hydraulic fluid supplied from the second pump to the main actuator.

This application is based on Japanese Patent Application No. 2016-020671 filed in Japan Patent Office on Feb. 5, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hydraulic drive system to be provided to a working machine including a working attachment having a distal end to which an optional device is mountable, for driving the working attachment and the optional device by hydraulic pressure, the hydraulic drive system comprising:

a main actuator connected to the working attachment so as to actuate the working attachment by receiving a supply of hydraulic fluid;

an optional actuator connected to the optional device so as to actuate the optional device by receiving a supply of hydraulic fluid;

a first pump that discharges hydraulic fluid;

a second pump that discharges discharging hydraulic fluid independently of the first pump;

a first main supply fluid line for leading hydraulic fluid discharged from the first pump to the main actuator;

an optional supply fluid line for leading hydraulic fluid discharged from the first pump to the optional actuator in parallel with the first main supply fluid line;

a second main supply fluid line for leading hydraulic fluid discharged from the second pump to the main actuator through a different path from the first main supply fluid line;

a main manipulating device to which a main control operation for manipulating the main actuator is applied;

an optional manipulating device to which an optional control operation for manipulating the optional actuator is applied;

a first main control valve operable to control the supply of hydraulic fluid to the main actuator through the first main supply fluid line in accordance with the main control operation applied to the main manipulating device;

an optional control valve operable to control the supply of hydraulic fluid to the optional actuator through the optional supply fluid line in accordance with the optional control operation applied to the optional manipulating device;

a second main control valve operable to control the supply of hydraulic fluid to the main actuator through the second main supply fluid line in accordance with the main control operation applied to the main manipulating device;

a bleed-off fluid line for returning hydraulic fluid discharged from the second pump to a tank so as to bypass the main actuator and the second main control valve;

a bleed-off flow rate regulating section configured to regulate a bleed-off flow rate which is the flow rate of hydraulic fluid flowing in the bleed-off fluid line; and a bleed-off control section configured to control the bleed-off flow rate regulating section to make the bleed-off flow rate corresponding to the control operation applied to the main manipulating device in a specific combined manipulation state where a specific main control operation for bringing the main actuator into specific action is applied to the main manipulating device and an optional control operation for operating the optional actuator is applied to the main manipulating device, simultaneously, be smaller than the bleed-off flow rate corresponding to the control operation in a single main manipulation state where no optional control operation is applied to the optional manipulating device while a main control operation is applied to the main manipulating device, wherein the bleed-off flow rate regulating section includes a bleed-off control valve disposed in the bleed-off fluid line, the bleed-off control valve including a signal input portion for receiving a bleed-off instruction signal, the bleed-off control valve being operable to change the opening area of the bleed-off control valve in accordance with the input bleed-off instruction signal input to the signal input portion, and wherein the bleed-off control section is configured to generate a bleed-off instruction signal in accordance with respective control operations applied to the main manipulating device and the optional manipulating device and to input the generated bleed-off instruction signal to the signal input portion of the bleed-off control valve.

2. The hydraulic drive system for a working machine according to claim 1, wherein the specific action of the main actuator is an action of displacing the optional device in a direction having an upward component against the force of gravity acting on the optional device.

3. A hydraulic drive system to be provided to a working machine including a working attachment having a distal end to which an optional device is mountable, for driving the working attachment and the optional device by hydraulic pressure, the hydraulic drive system comprising:

a main actuator connected to the working attachment so as to actuate the working attachment by receiving a supply of hydraulic fluid;

an optional actuator connected to the optional device so as to actuate the optional device by receiving a supply of hydraulic fluid;

a first pump that discharges hydraulic fluid;

a second pump that discharges discharging hydraulic fluid independently of the first pump;

a first main supply fluid line for leading hydraulic fluid discharged from the first pump to the main actuator;

an optional supply fluid line for leading hydraulic fluid discharged from the first pump to the optional actuator in parallel with the first main supply fluid line;

a second main supply fluid line for leading hydraulic fluid discharged from the second pump to the main actuator through a different path from the first main supply fluid line;

a main manipulating device to which a main control operation for manipulating the main actuator is applied;

an optional manipulating device to which an optional control operation for manipulating the optional actuator is applied;

a first main control valve operable to control the supply of hydraulic fluid to the main actuator through the first main supply fluid line in accordance with the main control operation applied to the main manipulating device;

an optional control valve operable to control the supply of hydraulic fluid to the optional actuator through the optional supply fluid line in accordance with the optional control operation applied to the optional manipulating device;

a second main control valve operable to control the supply of hydraulic fluid to the main actuator through the second main supply fluid line in accordance with the main control operation applied to the main manipulating device;

a bleed-off fluid line for returning hydraulic fluid discharged from the second pump to a tank so as to bypass the main actuator;

a bleed-off flow rate regulating section configured to regulate a bleed-off flow rate which is the flow rate of hydraulic fluid flowing in the bleed-off fluid line; and a bleed-off control section configured to control the bleed-off flow rate regulating section to make the bleed-off flow rate corresponding to the control operation applied to the main manipulating device in a specific combined manipulation state where a specific main control operation for bringing the main actuator into specific action is applied to the main manipulating device and an optional control operation for operating the optional actuator is applied to the main manipulating device, simultaneously, be smaller than the bleed-off flow rate corresponding to the control operation in a single main manipulation state where no optional control operation is applied to the optional manipulating device while a main control operation is applied to the main manipulating device, further comprising a pump flow rate control section configured to make the discharge flow rate of the second pump in the specific combined manipulation state be greater than the discharge flow rate in the single main manipulation state.

4. The hydraulic drive system for a working machine according to claim 3, wherein:

the bleed-off flow rate regulating section is a bleed-off flow path forming portion incorporated in the second main control valve so as to be located in an intermediate position of the bleed-off fluid line, the bleed-off flow path forming portion being formed so as to reduce the opening area of the bleed-off flow path forming portion with an opening action of the second main control valve in a direction to increase the flow rate of hydraulic fluid supplied from the second pump to the main actuator to bring the main actuator into the specific action; and the bleed-off control section is configured to operate the second main control valve to open by a stroke corresponding to the main control operation applied to the main manipulating device and to operate the second main control valve to open by a greater stroke in the specific combined manipulation state than a stroke of the second main control valve in the single main manipulation state, for the main control operation applied to the main manipulating device to thereby reduce the bleed-off flow rate.

5. The hydraulic drive system for a working machine according to claim 4, wherein the second main control valve is a pilot selector valve which receives a pilot pressure to open by a stroke corresponding to the input pilot pressure, and the bleed-off control section includes:

a pilot pressure regulating valve configured to change the pilot pressure input to the second main control valve to bring the main actuator into the specific action; and a pilot pressure control section configured to operate the pilot pressure regulating valve so as to change the pilot pressure in accordance with the main control operation applied to the main manipulating device and so as to make the pilot pressure in the specific combined manipulation state be greater than the pilot pressure in the single manipulation state, for the main control operation applied to the main manipulating device.

6. The hydraulic drive system for a working machine according to claim 4, wherein the second main control valve is a pilot selector valve which receives a pilot pressure to open by a stroke corresponding to the input pilot pressure, and the bleed-off control section includes:

a pilot pressure regulating valve configured to change the pilot pressure input to the second main control valve to bring the main actuator into the specific action; and a pilot pressure control section configured to operate the pilot pressure regulating valve so as to change the pilot pressure in accordance with the main control operation applied to the main manipulating device and so as to make the pilot pressure in the specific combined manipulation state be greater than the pilot pressure in the single manipulation state, for the main control operation applied to the main manipulating device.

7. The hydraulic drive system for a working machine according to claim 3, wherein:

the bleed-off flow rate regulating section includes a bleed-off control valve disposed in the bleed-off fluid line, the bleed-off control valve including a signal input portion for receiving a bleed-off instruction signal, the bleed-off control valve being operable to change the opening area of the bleed-off control valve in accordance with the input bleed-off instruction signal input to the signal input portion; and the bleed-off control section is configured to generate a bleed-off instruction signal in accordance with respective control operations applied to the main manipulating device and the optional manipulating device and to input the generated bleed-off instruction signal to the signal input portion of the bleed-off control valve.

8. The hydraulic drive system for a working machine according to claim 3, wherein the specific action of the main actuator is an action of displacing the optional device in a direction having an upward component against the force of gravity acting on the optional device.

9. A hydraulic drive system to be provided to a working machine including a working attachment having a distal end to which an optional device is mountable, for driving the working attachment and the optional device by hydraulic pressure, the hydraulic drive system comprising:

a main actuator connected to the working attachment so as to actuate the working attachment by receiving a supply of hydraulic fluid;

an optional actuator connected to the optional device so as to actuate the optional device by receiving a supply of hydraulic fluid;

a first pump that discharges hydraulic fluid;

a second pump that discharges discharging hydraulic fluid independently of the first pump;

a first main supply fluid line for leading hydraulic fluid discharged from the first pump to the main actuator;

an optional supply fluid line for leading hydraulic fluid discharged from the first pump to the optional actuator in parallel with the first main supply fluid line;

a second main supply fluid line for leading hydraulic fluid discharged from the second pump to the main actuator through a different path from the first main supply fluid line;

a main manipulating device to which a main control operation for manipulating the main actuator is applied;

an optional manipulating device to which an optional control operation for manipulating the optional actuator is applied;

a first main control valve operable to control the supply of hydraulic fluid to the main actuator through the first main supply fluid line in accordance with the main control operation applied to the main manipulating device;

an optional control valve operable to control the supply of hydraulic fluid to the optional actuator through the optional supply fluid line in accordance with the optional control operation applied to the optional manipulating device;

a second main control valve operable to control the supply of hydraulic fluid to the main actuator through the second main supply fluid line in accordance with the main control operation applied to the main manipulating device;

a bleed-off fluid line for returning hydraulic fluid discharged from the second pump to a tank so as to bypass the main actuator;

a bleed-off flow rate regulating section configured to regulate a bleed-off flow rate which is the flow rate of hydraulic fluid flowing in the bleed-off fluid line; and a bleed-off control section configured to control the bleed-off flow rate regulating section to make the bleed-off flow rate corresponding to the control operation applied to the main manipulating device in a specific combined manipulation state where a specific main control operation for bringing the main actuator into specific action is applied to the main manipulating device and an optional control operation for operating the optional actuator is applied to the main manipulating device, simultaneously, be smaller than the bleed-off flow rate corresponding to the control operation in a single main manipulation state where no optional control operation is applied to the optional manipulating device while a main control operation is applied to the main manipulating device, further comprising: a merging fluid line for merging a part of hydraulic fluid discharged from the second pump into hydraulic fluid discharged from the first pump; a merging selector valve configured to be switched between a state of blocking the merging fluid line and a state of opening the merging fluid line; and a merging selection control section configured to operate the merging selector valve to open the merging fluid line in an single optional manipulation state where no main control operation is applied to the main manipulating device while an optional control operation is applied to the optional manipulating device and to operate the merging selector valve to block the merging fluid line in the specific combined manipulation state.

10. The hydraulic drive system for a working machine according to claim 9, wherein:

the bleed-off flow rate regulating section includes a bleed-off control valve disposed in the bleed-off fluid line, the bleed-off control valve including a signal input portion for receiving a bleed-off instruction signal, the bleed-off control valve being operable to change the opening area of the bleed-off control valve in accordance with the input bleed-off instruction signal input to the signal input portion; and the bleed-off control section is configured to generate a bleed-off instruction signal in accordance with respective control operations applied to the main manipulating device and the optional manipulating device and to input the generated bleed-off instruction signal to the signal input portion of the bleed-off control valve.

11. The hydraulic drive system for a working machine according to claim 9, wherein:

the bleed-off flow rate regulating section is a bleed-off flow path forming portion incorporated in the second main control valve so as to be located in an intermediate position of the bleed-off fluid line, the bleed-off flow path forming portion being formed so as to reduce the opening area of the bleed-off flow path forming portion with an opening action of the second main control valve in a direction to increase the flow rate of hydraulic fluid supplied from the second pump to the main actuator to bring the main actuator into the specific action; and the bleed-off control section is configured to operate the second main control valve to open by a stroke corresponding to the main control operation applied to the main manipulating device and to operate the second main control valve to open by a greater stroke in the specific combined manipulation state than a stroke of the second main control valve in the single main manipulation state, for the main control operation applied to the main manipulating device to thereby reduce the bleed-off flow rate.

12. The hydraulic drive system for a working machine according to claim 11, wherein the second main control valve is a pilot selector valve which receives a pilot pressure to open by a stroke corresponding to the input pilot pressure, and the bleed-off control section includes:

a pilot pressure regulating valve configured to change the pilot pressure input to the second main control valve to bring the main actuator into the specific action; and a pilot pressure control section configured to operate the pilot pressure regulating valve so as to change the pilot pressure in accordance with the main control operation applied to the main manipulating device and so as to make the pilot pressure in the specific combined manipulation state be greater than the pilot pressure in the single manipulation state, for the main control operation applied to the main manipulating device.

13. The hydraulic drive system for a working machine according to claim 9, wherein the specific action of the main actuator is an action of displacing the optional device in a direction having an upward component against the force of gravity acting on the optional device.

* * * * *